US006666237B2

(12) United States Patent
De Antoni Migliorati et al.

(10) Patent No.: US 6,666,237 B2
(45) Date of Patent: Dec. 23, 2003

(54) DISPENSING DEVICE IN MACHINES FOR FILLING CONTAINERS WITH POWDER MATERIAL

(75) Inventors: Narciso De Antoni Migliorati, Castiglione delle Stiviere (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/098,633

(22) Filed: Mar. 18, 2002

(65) Prior Publication Data

US 2003/0029516 A1 Feb. 13, 2003

(Under 37 CFR 1.47)

(30) Foreign Application Priority Data

Mar. 20, 2001 (IT) ..... BO2001A0154

(51) Int. Cl.[7] ..... B65B 1/04

(52) U.S. Cl. ..... 141/286; 141/301; 251/212

(58) Field of Search ..... 141/286, 301, 141/67, 10, 114, 313–316; 251/212

(56) References Cited

U.S. PATENT DOCUMENTS 5,806,725 A 9/1998 Bennett

*Primary Examiner*—Steven O. Douglas
(74) *Attorney, Agent, or Firm*—Davidson Berquist Klima & Jackson, LLP

(57) ABSTRACT

A dispensing device for a powder filling machine comprises a duct with at least one dispensing outlet from which a powder material is directed into a container positioned beneath. The outlet incorporates an iris diaphragm with a plurality of occluding elements capable of movement between an operating condition in which the outlet is closed, disallowing passage of the powder material, and a non-operating condition in which the outlet is open, with the occluding elements compassing a flow section aligned concentrically with the duct and allowing the passage of the powder material.

21 Claims, 5 Drawing Sheets

DISPENSING DEVICE IN MACHINES FOR FILLING CONTAINERS WITH POWDER MATERIAL

BACKGROUND OF THE INVENTION

The present invention relates to a dispensing device for powder material.

In particular, the present invention finds application advantageously in the art field of automatic filling machines equipped with a carousel carrying a plurality of filler heads from which powder material is dispensed into containers.

Each of the aforementioned filler heads comprises a dispensing device designed to direct a given quantity of material by free fall into a relative container positioned on a platform assembly. The platform assembly is equipped with a load cell, located beneath the assembly and connected to the dispensing device, which serves to sense the weight of the container during the fill. Once the load cell senses a predetermined value corresponding to the final filled condition of the container, it will pilot the dispensing device to cut off the flow of powder material.

More exactly, the dispensing device receives the powder material from a vessel by way of a feed duct connected to a bottom end of the selfsame vessel, in such a way that the material can be released by gravity and in measured quantities. In addition, the dispensing device comprises an element located to coincide with an outlet at the bottom end of the duct, by means of which the duct can be closed off selectively.

A first such closure element embraced by the prior art presents a valve consisting in a lever mounted pivotably to a fixed supporting frame. The lever exhibits a substantially circular portion positionable under the outlet in such a way as to close it off completely.

The valve is operated through the agency of a relative linear actuator that shifts the lever by causing it to rotate about the pivot axis. Thus, the circular portion is directed along a path transverse to the longitudinal axis of the duct and into a position under the outlet in such a way as to occlude the selfsame outlet and cut off the flow of powder material.

In reality, the filling method outlined above betrays a drawback connected with the operation of closing the outlet. As the circular portion moves across, in effect, the powder material in flight is diverted and consequently does not drop correctly into the container.

This drawback is attributable to the nature of the movement described by the circular portion, which drags a part of the powder material along the direction of this same movement (transverse to the direction of the flight), diverting it and causing it to spill outside the container. The part of the material not directed into the container thus drops onto the platform assembly, creating problems in the sense that the machine must be cleaned and a proportion of the powder material remains unused.

The prior art also embraces devices that comprise a feed duct extending through an annular chamber. The duct remains fluid-tight with respect to the annular chamber, which is associated with extractor means and caused to draw in air through an annular port coaxial with the outlet of the duct.

Thus, the part of the powder material diverted by the valve is intercepted and aspirated through the port into the annular chamber.

The aspirated material is then returned to the vessel for subsequent reuse.

Even with this second prior art solution however, there is a significant drawback attributable to the constructional complexity of the extraction system. In effect, carousel filling machines are generally equipped with a not inconsiderable number of filler heads. Consequently, if an extraction system of the type previously outlined is to be associated with each of the dispensing devices, this represents an excessive increase in production costs per single filling machine.

A further drawback derives from the fact that the extraction system can be rendered ineffective when the machine is employed to dispense certain powder materials of which the particles are notably heavy. In this instance the particles remain unaffected by the aspirating action, which is not sufficient to counteract the gravitational force that causes the particles diverted away from the container mouth to continue falling.

The object of the present invention is to provide a dispensing device for powder filling machines operating with containers, which will betray none of the aforementioned drawbacks.

In particular, it is an object of the invention to provide a dispensing device for powder filling machines operating with containers, such as will cut off the flow of powder material without any part of the material being scattered outside the container.

SUMMARY OF THE INVENTION

The stated object is realized according to the present invention in a dispensing device applicable to machines for filling containers with powder material, comprising a feed duct referable to a longitudinal axis and furnished with at least one outlet from which the powder material is dispensed into a corresponding container; also closure means associated with the outlet, capable of movement between an operating condition in which the outlet is closed to disallow the passage of the powder material, and a non-operating condition in which the outlet remains open Closure means according to the invention comprise a plurality of occluding elements each capable of movement between a first position corresponding to the operating condition of the closure means, and at least a second position corresponding to the non-operating condition of the closure means. The single occluding element obscures a part of the dispensing outlet when in the first position, and combines with the remaining elements when in the second position to establish a flow section affording a passage to the powder material.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
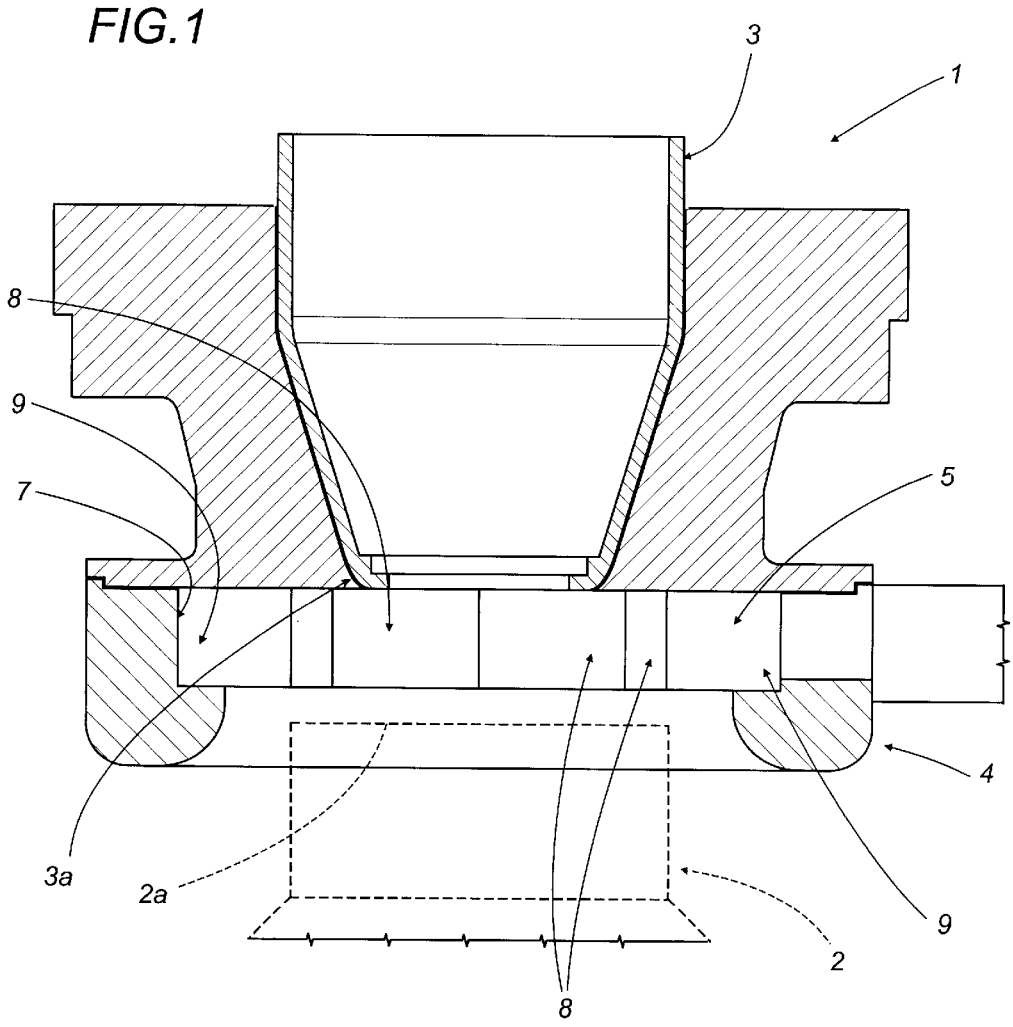
FIG. 1 illustrates a first preferred embodiment of a dispensing device in accordance with the present invention, applicable to machines for filling containers with powder material, viewed schematically in a side elevation and with certain parts omitted for clarity.

With reference to FIG. 1 of the accompanying drawings, 1 denotes a dispensing device, in its entirety, for machines used to fill containers 2 with powder material. In particular, the filling machines in question are of the type mentioned in the foregoing prior art statement.

The device 1 comprises a duct 3 of substantially tubular embodiment, terminating in a first end 3*a* furnished with an outlet 4 from which the powder material is dispensed. At the end opposite from the first end 3*a,* the duct 3 is connected to a vessel (not illustrated in the drawings) containing the aforementioned powder material.

The dispensing outlet 4 is positioned above a relative container 2, illustrated schematically in FIG. 1 and presenting a mouth 2*a* directed toward the outlet 4. More exactly, the outlet 4 presents the shape substantially of a ring with an internal peripheral surface 6 affording a channel 7 such as will accommodate sliding movement. The channel 7 consists advantageously in a groove extending the full developable length of the internal peripheral surface 6.

The dispensing device 1 further comprises closure means 5 associated with the outlet 4, such as can alternate between an operating condition in which the outlet 4 is closed to disallow the passage of the powder material, and a non-operating condition in which the outlet 4 remains open to allow the passage of the selfsame material.

Such closure means 5, which in FIG. 1 of the drawings are shown in the non-operating condition, consist in a plurality of occluding elements 8 occupying the outlet 4, each with a peripheral portion 9 inserted slidably in the channel 7.

Figure 2:
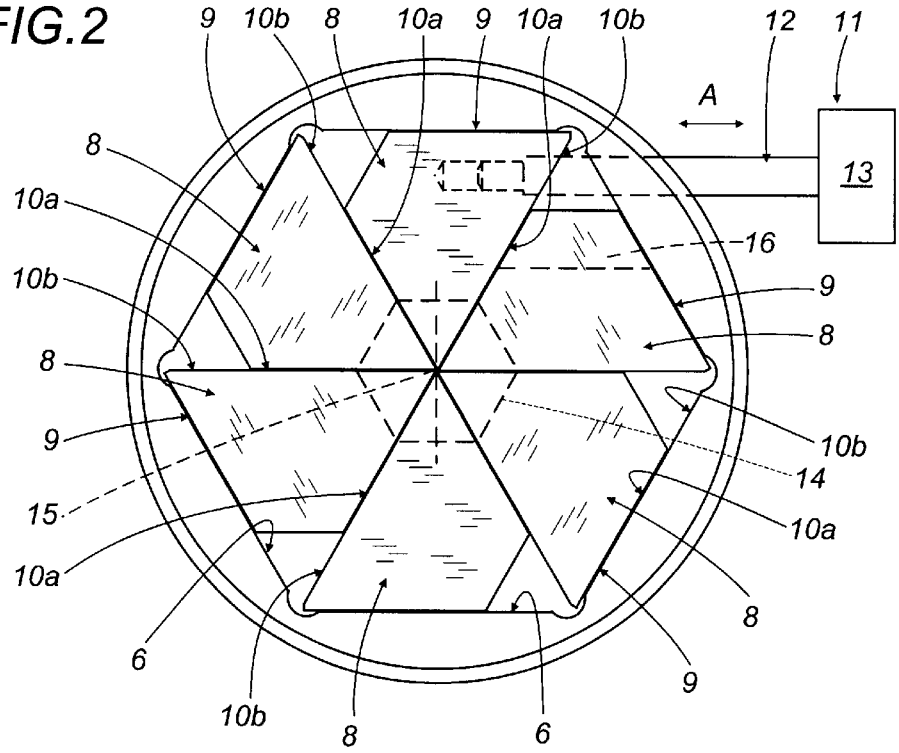
FIG. 2 illustrates the device of FIG. 1 in a first operating condition, viewed in plan with certain parts omitted for clarity.

More exactly, and with reference to FIG. 2, the internal peripheral surface 6 of the outlet 4 is of substantially polygonal, and preferably hexagonal geometry.

Each occluding element 8 appears substantially as a plate, presenting a trapezoidal and preferably isosceles geometry when viewed in plan. Thus, the peripheral portion 9 of each element 8 is defined by one of the oblique sides of the trapezium, whilst the oblique side opposite and the greater base constitute respective first and second peripheral sliding surfaces 10*a* and 10*b.*

There are six occluding elements 8 in the example of FIG. 2, each disposed with the oblique side constituting the peripheral portion 9 offered to a relative side of the hexagonal internal peripheral surface 6 of the outlet 4.

In this configuration, the peripheral sliding surfaces 10*a* and 10*b* of the occluding elements 8 are offered in sliding contact one to another. More exactly, each occluding element 8 is disposed with the first peripheral sliding surface 10*a,* that is to say the oblique side remote from that coinciding with the peripheral portion 9, butted against the second peripheral sliding surface 10*b* or greater trapezoidal base of the relative adjacent occluding element 8.

Thus, the occluding elements 8 are translatable one relative to the next along their respective peripheral sliding surfaces 10*a* and 10*b,* and along the peripheral portions 9, between a first position corresponding to the closed operating condition of the closure means 5, and at least a second position that corresponds to the non-operating condition of the closure means 5. In the first position, each occluding element 8 obscures a part of the outlet 4 so that as an assembly the elements 8 will combine to occlude the outlet 4 completely.

Also forming part of the dispensing device 1 are drive means 11 associated with at least one of the occluding elements 8, by which the elements 8 can be translated steplessly between the first and the second position, as will be seen in due course, through a series of intermediate positions.

The drive means 11 consist in an actuator 13 comprising a rod 12 anchored at one end to one of the occluding elements 8 and caused to reciprocate along a direction, denoted A, coinciding with its own longitudinal axis and extending parallel to the peripheral portion 9 of the occluding element 8 with which the drive means 11 are associated.

Figure 3:
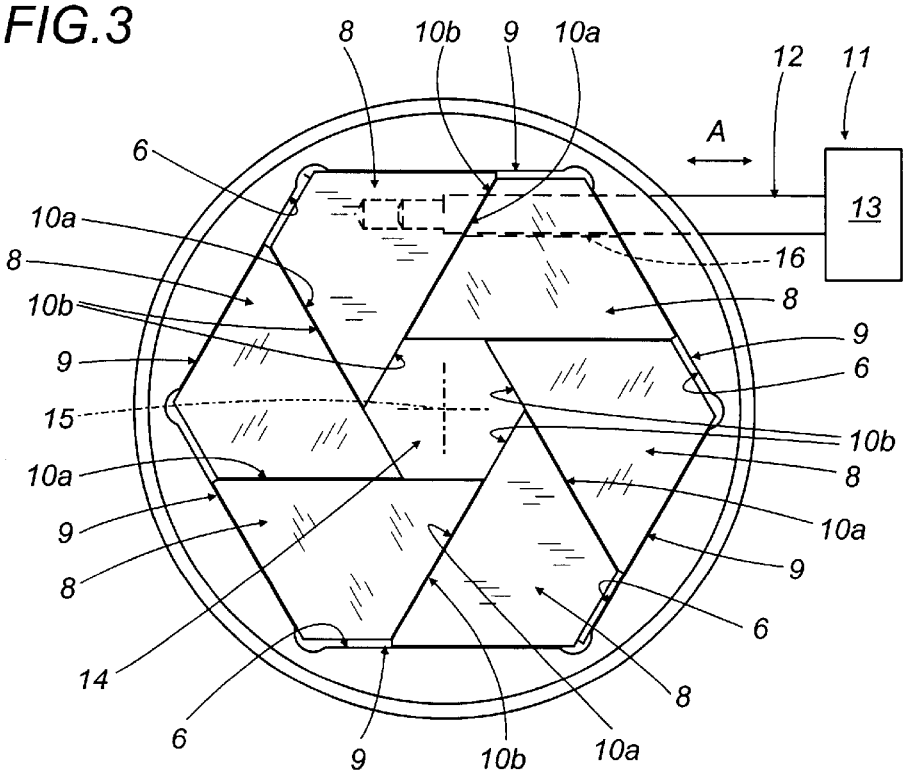
FIG. 3 illustrates the device of FIG. 2 in a second operating condition.

In the second position, the occluding elements 8 establish a flow section 14 aligned concentrically with the longitudinal axis 15 of the duct 3, as illustrated in FIG. 3, and affording a passage to the powder material.

The flow section 14 is compassed by a portion of the second peripheral sliding surface 10*b* of each occluding element 8 directed toward the center of the outlet 4. During the movement between the first and the second position, the occluding elements 8 will define a succession of concentric intermediate sections smaller than that of the flow section 14 established when the elements 8 occupy the second position.

As discernible in FIGS. 2 and 3, one occluding element 8, disposed with a first peripheral sliding surface 10*a* engaging the second peripheral sliding surface 10*b* of the occluding element 8 associated with the drive means 11, presents an opening that serves to accommodate the actuator rod 12.

Figure 4:
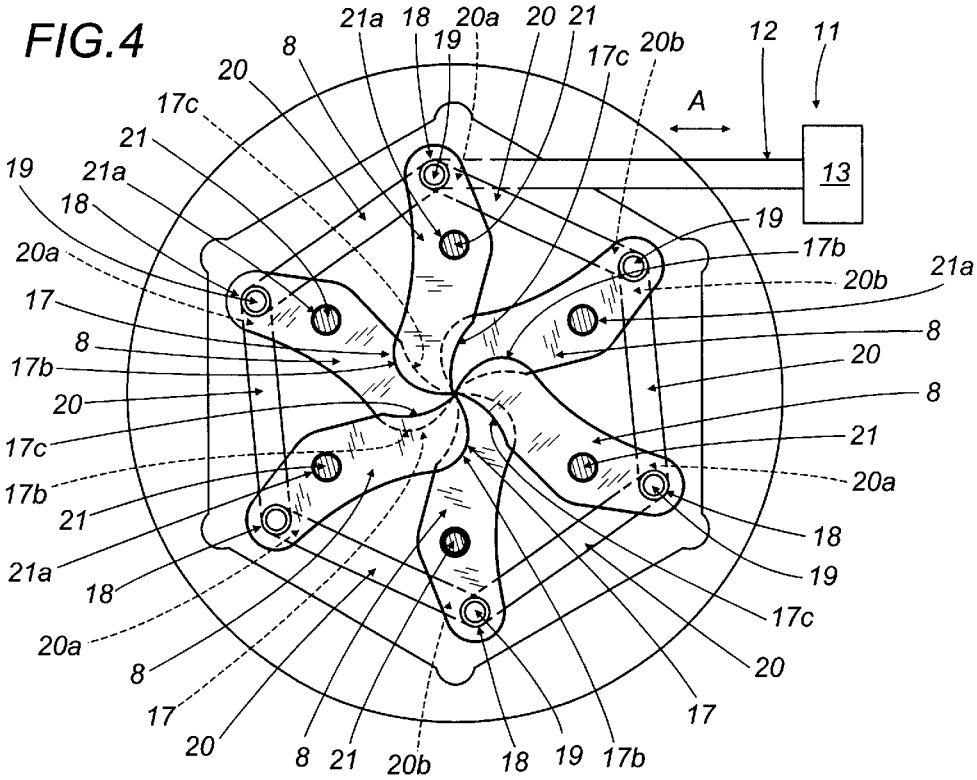
FIG. 4 illustrates a second embodiment of the dispensing device according to the invention, viewed in plan with certain parts omitted for clarity and in a first operating condition.

With reference to FIG. 4, which illustrates a second embodiment of the dispensing device 1, the occluding elements 8 each present a substantially elongated appearance.

Each occluding element 8 presents a substantially wedge-like portion 17 at one end, terminating in a vertex 17*a* that coincides with the longitudinal axis 15 of the duct 3 when the occluding element 8 occupies the first position.

The wedge-like portion 17 is defined by a convex edge 17*b* and a concave edge 17*c* converging on the vertex 17*a*.

The end of the occluding element 8 opposite from the wedge-like portion 17 incorporates a hinge 18 embodied as a through hole afforded by the selfsame element 8, freely accommodating a first pivot 19 disposed parallel to the longitudinal axis 15 of the duct 3. The occluding elements 8 are connected at points coinciding with these same hinges 18 to a plurality of rod-like link elements 20. Thus, each link element 20 is associated with two occluding elements 8.

More exactly, each link element 20 presents a first end 20*a,* and a second end 20*b* remote from the first end, both of which affording a through hole. Each first pivot 19 engages the hole in the first end 20*a* of one link element 20 and the hole in the second end 20*b* of a adjacent link element 20, with the result that all the occluding elements 8 are connected mechanically one with another Each occluding element 8 is associated with the dispensing outlet 4 by way of a fulcrum pivot 21, anchored permanently to the peripheral part of the selfsame outlet and occupying a hole 21*a* located between the wedge-like portion 17 and the hinge 18 of the occluding element 8.

The fulcrum pivot 21 extends longitudinally in a direction parallel to the longitudinal axis 15 of the duct 3. Accordingly, the occluding elements 8 are rotatable, each about the respective fulcrum pivot 21, between the first and second positions. The second embodiment in question likewise has six occluding elements 8 arranged peripherally around the outlet 4, in this instance occupying different planes lying transverse to the longitudinal axis 15 of the duct 3. In the first position, the occluding elements 8 are disposed with the respective wedge-like portions 17 converging radially on the center of the outlet 4. In this configuration, the concave and the convex edges 17*b* and 17*c* of the wedge-like portions 17 overlap one another.

In this second embodiment, the rod 12 of the drive means 11 can be associated to advantage with one of the link elements 20, or directly with the hinge 18 of a relative occluding element 8.

Figure 5:
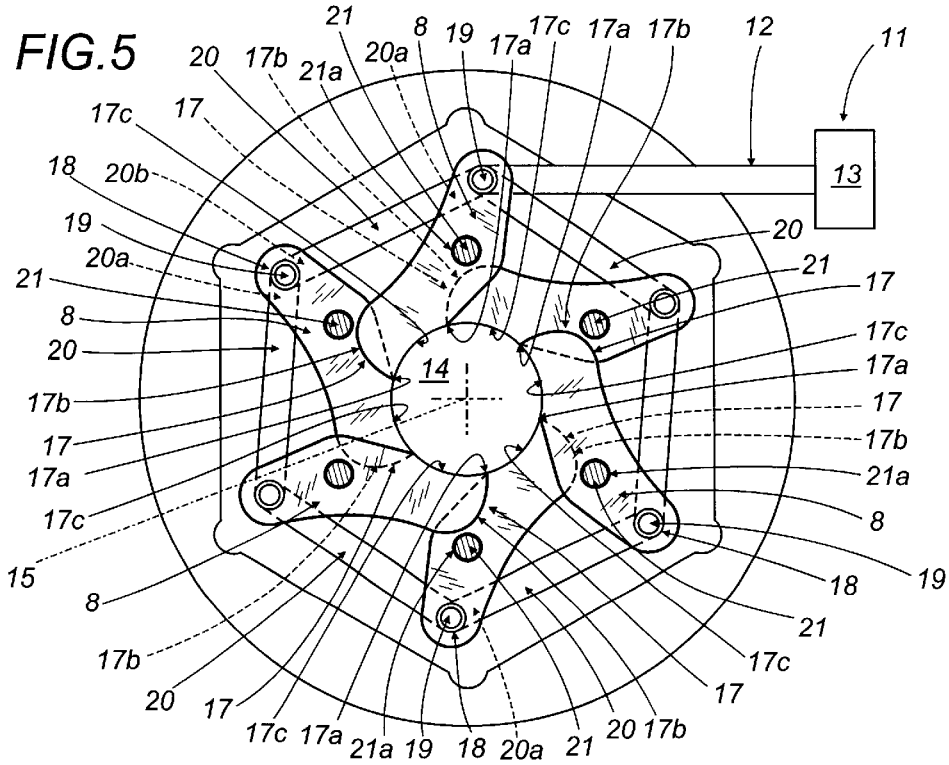
FIG. 5 illustrates the device of FIG. 4 in a second operating condition.

Referring to FIG. 5, the occluding elements 8 are disposed, when in the second position, with the wedge-like portions 17 tangential to the outlet 4. In this configuration, the concave edges 17*c* of the single occluding elements 8 are disposed in such a manner as to establish a flow section 14 appearing substantially circular in shape.

FIGS. 6, 7, 8 and 9 of the drawings illustrate two embodiments of the device differing from one another in terms of the particular shape exhibited by the singe occluding element 8.

Figure 6:
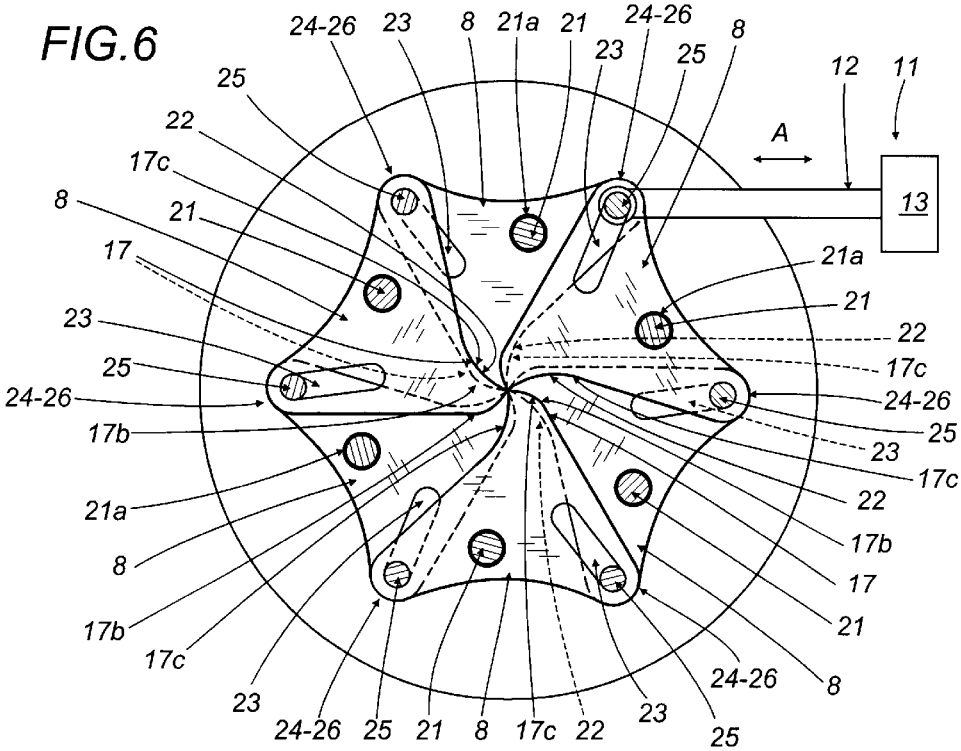
FIGS. 6 to 9 illustrate a third and a fourth embodiment of the dispensing device according to the invention, viewed in plan with certain parts omitted for clarity and shown respectively in the two operating conditions.

More exactly, FIG. 6 illustrates an occluding element 8 of substantially triangular outline, again presenting a wedge-like portion 17 of which the vertex 17*a* coincides with a first vertex 22 of the triangular figure.

As in the previous embodiment, the wedge-like portion 17 presents a convex edge 17*b* and a concave edge 17*c*. Each two adjacent occluding elements 8 occupy different planes lying transverse to the longitudinal axis 15 of the duct 3, so that the concave and convex edges 17*b* and 17*c* overlap one another.

In this embodiment of the device, each occluding element 8 affords a slot 23 positioned at a second vertex 24 and accommodating a second pivot 25. This pivot 25 is associated with a third vertex 26 of each occluding element 8, which consequently is coupled to the slot 23 of the adjacent element 8.

With a fulcrum pivot 21 positioned between the second and third vertices 24 and 26, the occluding element 8 is able to rotate between the first and second position. Likewise in this embodiment, the fulcrum pivot 21 is anchored permanently to the peripheral part of the outlet 4.

Figure 7:
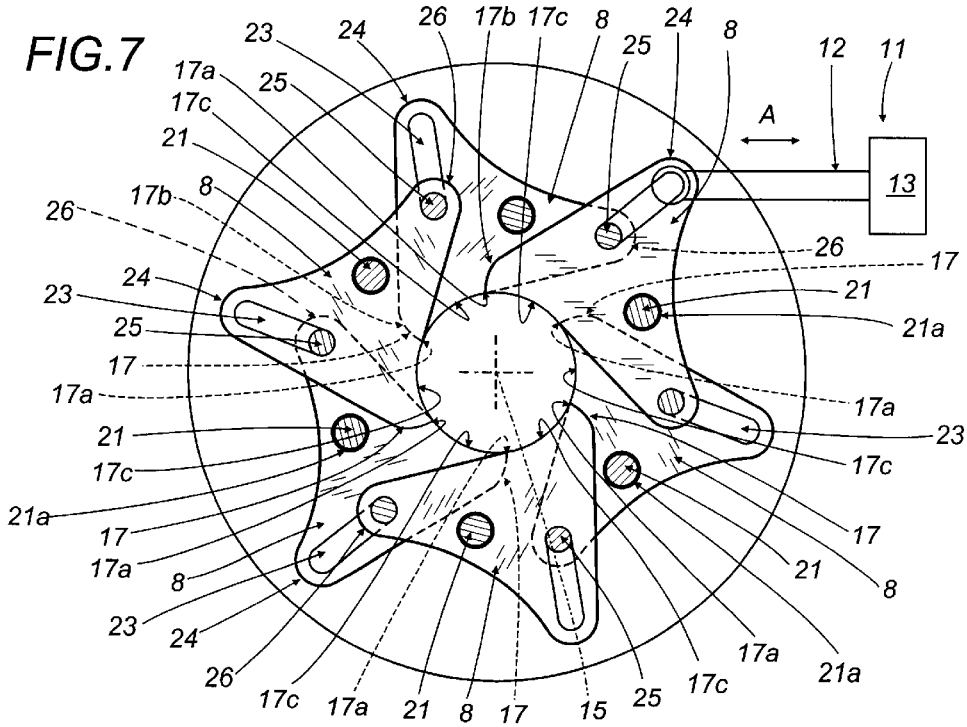

In the second position of the device, illustrated in FIG. 7, the occluding elements 8 are disposed in the same manner as those of the embodiment shown in FIG. 5, with the concave edges 17*c* combining to establish a circular flow section 14 and the wedge-like portions 17 tangential to the outlet 8. During the movement between the first and second positions, the pivot 25 associated with the third vertex 26 of each occluding element 8 is caused to slide along the respective slot 23. Again in this embodiment, the rod 12 is coupled advantageously to at least one of the occluding elements 8.

Figure 8:
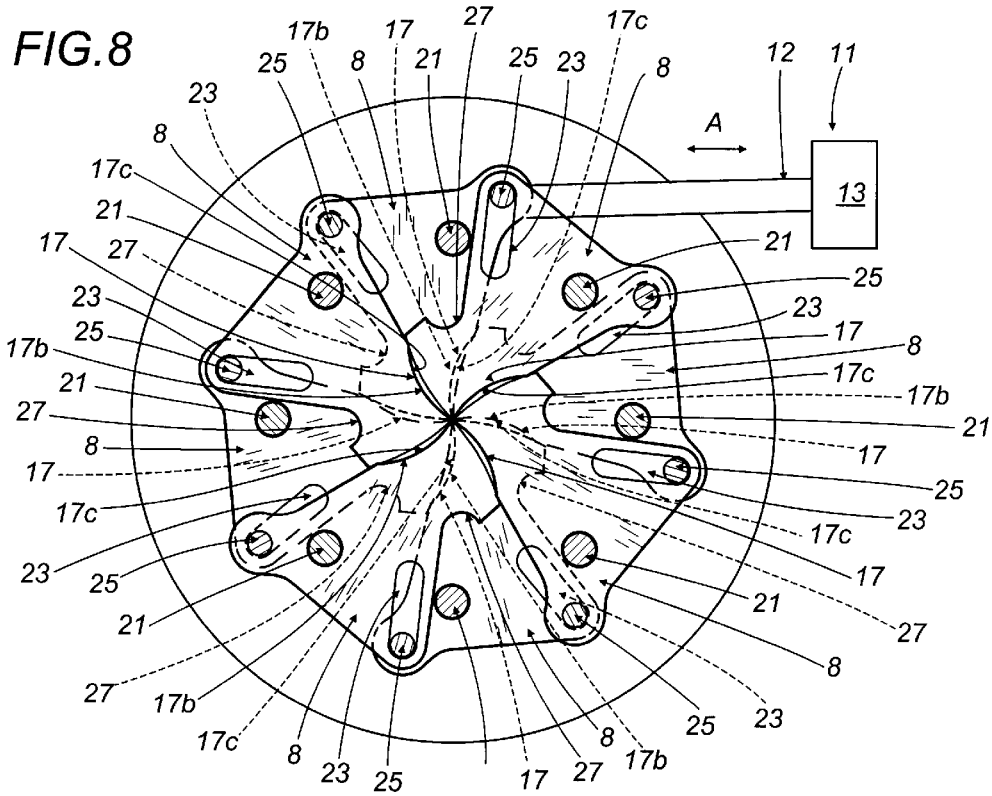

With reference to FIG. 8, which illustrates a further embodiment of the dispensing device 1, the occluding elements 8 are substantially triangular in embodiment as described above in referring to the embodiment of FIG. 6.

Again, there is a wedge-like portion 17 with a concave edge 17*c* and a convex edge 17*b*, the latter in this instance presenting a recess 27 at a given point along its length.

Figure 9:
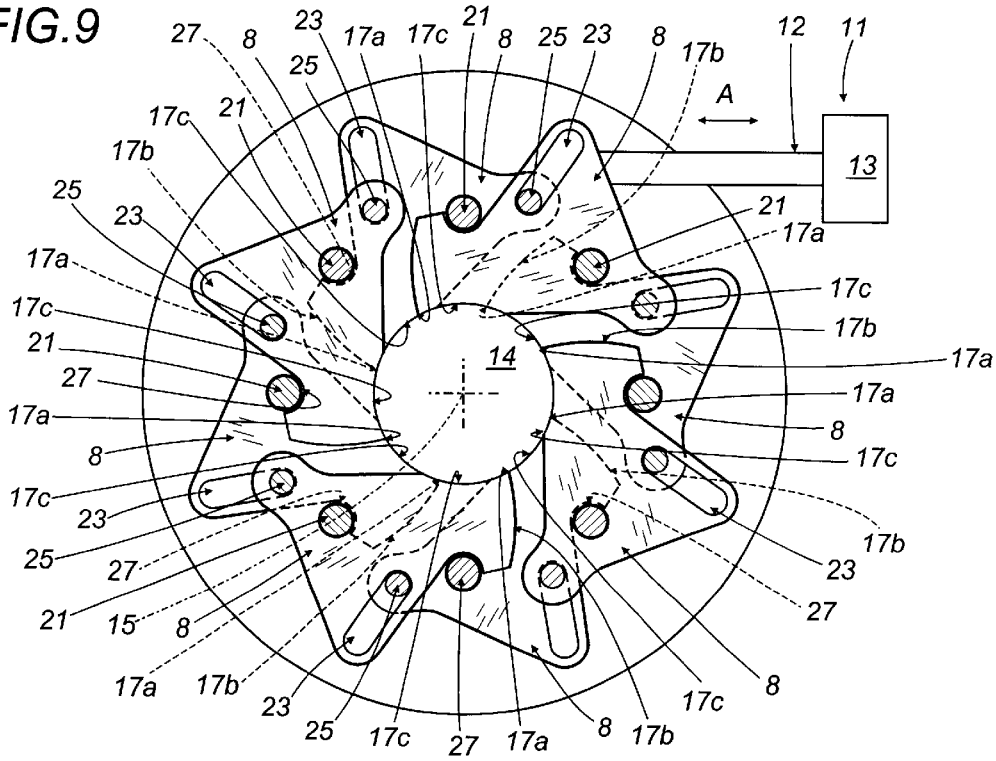

Referring to FIG. 9, the recess 27 is disposed in such a way that when the occluding elements 8 occupy the second position, the portion of each element 8 overlapping the adjacent element 8 will not interfere with the fulcrum pivot 21 of the selfsame adjacent occluding element.

In operation, referring to the first embodiment of the device illustrated in FIGS. 1, 2 and 3, the rod 12 is set in motion by the actuator 13, which can be embodied advantageously as an electro magnet.

The rod 12 displaces the occluding element 8 with which it is associated, in the direction denoted A, causing the relative peripheral portion 9 to slide within the channel 7 along a path that corresponds to one side of the hexagonal internal peripheral surface 6. As a result, the occluding element 8 in question passes from the first position illustrated in FIG. 2 to the second position illustrated in FIG. 3.

The occluding element 8 driven directly by the rod 12 also pushes against the adjacent element 8, causing the relative peripheral portion 9 to slide within the channel 7 along a path that corresponds to the side of the hexagonal internal peripheral surface 6 with which this same adjacent element 8 is associated.

More precisely, the first peripheral sliding surface 10*a* of the occluding element 8 actuated directly by the rod 12 pushes against the second peripheral sliding surface 10*b* of the adjacent occluding element 8 with which it is in contact. In this way, the occluding element 8 subjected to the pushing force will slide between the channel 7 and the peripheral surface 10*a* of the driving element, moving in a direction substantially transverse to the longitudinal axis 15 of the duct 3.

The movement generated in this way is transmitted similarly to all of the occluding elements 8, which will translate one relative to the next with the respective peripheral surfaces 10*a* and 10*b* sliding one against another, moving along the channel 7 to assume the second position illustrated in FIG. 3.

In this way, the elements combine to create a flow section 14 disposed concentrically with the longitudinal axis 15 of the duct and affording a passage to the powder material.

A predetermined quantity of powder material is allowed to flow into the container, and when this is sensed by a load cell (not illustrated in the drawings) associated with the filling machine, the drive means 11 will return the occluding elements 8 to the first position, reducing the flow section 14 and closing the passage.

As the occluding elements 8 move from the second position back to the first position, a portion of each element 8 is caused to occupy an increasingly larger part of the flow section 14, the effect of which being to define a succession of progressively smaller and concentric intermediate sections 14. These intermediate sections 14 continue to reduce gradually in width until the occluding elements 8 return to the first position, corresponding to the operating condition of the closure means 5, in which passage of the powder material is disallowed.

Advantageously, the flow of powder material in flight toward the container 2 is cut off without undergoing any change in direction (which coincides with the longitudinal axis 15 of the duct 3).

The advantage in question is attributable to the movement of the occluding elements 8, which, in the process of returning from the second to the first position, combine one with another to ensure the powder material passes consistently through a flow section centered on the longitudinal axis 15 of the duct 3. Accordingly, there is no displacement of the powder material in any direction transverse to the longitudinal axis 15 such as could result in a diversion away from the container 2, as occurs with devices embodied according to the prior art In the second embodiment of FIGS. 4 and 5, the occluding elements 8 are connected one to another by the link elements 20 and caused thus to rotate about the fulcrum pivots 21. In like manner to the first embodiment, the occluding element 8 driven directly by the actuator rod 12 is set in motion, and its movement transmitted mechanically to the other elements 8.

In particular, the occluding element 8 driven directly by the rod 12 rotates on its pivot 21 and the relative hinge 18 is caused thus to shift in a direction transverse to the longitudinal axis 15 of the duct 3. The hinge 18 in turn displaces the link element 20 with which it is associated, and thereby displaces all the link elements 20 and hinges 18 associated with the other occluding elements 8.

Accordingly, all the occluding elements 8 rotate in the same direction, with the result that the respective wedge-like portions 17 are distanced from the center of the outlet 4 and moved from the first position (illustrated in FIG. 4) to the second position (illustrated in FIG. 5).

When occupying the second position, the occluding elements 8 combine to establish the flow section 14 presented to the powder material. In this position the concave edges 17*c* of the single elements 8 are arranged in a circular formation and with no break in continuity, describing the circumference of the section 14.

Once the predetermined amount of powder material has been dispensed, the occluding element 8 driven directly by the rod 12 is set in motion, causing the rest of the occluding elements 8 to rotate in the direction opposite to the previous direction and return thus from the second position to the first position. During the course of this movement, with the wedge-like portions 17 encroaching on the flow section 14, the vertices 17*a* converge on the center of the outlet 4 to the point at which they become radially disposed relative to the selfsame outlet 4.

As in the case of the first embodiment described, the wedge-like portions 17 occupy an increasingly larger part of the flow section 14 during their movement from the second position to the first position, defining a succession of intermediate flow sections 14. These intermediate sections 14 continue to reduce gradually in width, remaining concentric, with the result that the advantages mentioned in describing the operation of the first embodiment are the same in the case of this second embodiment.

With regard to the operation of the third and fourth embodiments illustrated in FIGS. 6 to 9, the occluding element 8 associated directly with the drive means 11 is caused to rotate about the relative fulcrum pivot 21 in the manner described previously when referring to the operation of the second embodiment.

During its movement from the first position (FIG. 6) to the second position (FIG. 7), the occluding element 8 in question rotates in such a manner that the second vertex 24 is distanced from the center of the outlet 4 and the third vertex 26 consequently moved toward the outlet 4. This causes the pivot 25 of the adjacent occluding element 8 to be pulled by the corresponding slot 23 and drawn in sliding contact toward the outlet 4. The movement induced in the occluding element 8 driven directly by the rod 12 thus occasions the rotation of all the other occluding elements 8 linked mechanically one with another.

When occupying the second position, the occluding elements 8 are disposed, similarly to those of the second embodiment described, with the respective vertices 17*a* tangential to the longitudinal axis 15 of the duct 3 and the concave edges 17*c* combining to define the circumference of the flow section 14.

In the case of the fourth embodiment illustrated in FIGS. 8 and 9, the operation is substantially the same as that of the third embodiment.

Whilst the overlapping contact between adjacent occluding elements 8 is more pronounced in this instance, there is no interference between the one occluding element 8 and the fulcrum pivot 21 of the overlapped element 8.

This feature is obtained as result of furnishing each occluding element 8 with the recess 27, which locates freely against the fulcrum pivot 21 of the adjacent occluding element 8 when occupying the second position. Thus, notwithstanding the fulcrum pivot 21 is rigidly associated with the outlet 4, extending parallel to the longitudinal axis 15 of the duct 3, it remains unaffected by the movement of the overlapping element 8.

As any person skilled in the art will appreciate, all of the alternative embodiments illustrated have the advantage of presenting a flow section to the powder material that remains aligned concentrically with the longitudinal axis 15 of the feed duct 3. Accordingly, the powder material is not diverted along directions transverse to the longitudinal axis 15 but drops correctly into the container 2.

What is claimed:

1. A dispensing device in machines for filling containers with powder material, comprising:

a feed duct referable to a longitudinal axis and furnished with at least one outlet from which powder material is dispensed into a corresponding container; and closure means associated with the outlet, capable of movement between an operating condition in which the outlet is closed to disallow the passage of the powder material and a non-operating condition in which the outlet remains open, wherein the closure means comprises a plurality of occluding elements each capable of movement between a first position corresponding to the operating condition of the closure means and at least a second position corresponding to the non-operating condition of the closure means, each occluding element obscuring a part of the dispensing outlet when in the first position and combining with the remaining elements when in the second position to establish a flow section affording a passage to the powder material, each occluding element being directly and mechanically connected with at least one other adjacent occluding element.

2. A device as in claim 1, wherein the occluding elements are capable of movement steplessly between the first and second positions, passing through a succession of intermediate positions in which the selfsame occluding elements combine one with another to define respective intermediate flow sections afforded to the powder material.

3. A device as in claim 2, wherein the intermediate flow sections are mutually concentric.

4. A device as in claim 3, wherein the intermediate flow sections are concentric with the longitudinal axis of the duct.

5. A device as in claim 1, wherein the occluding elements extend circumferentially around the periphery of the dispensing outlet, further comprising drive means by which the occluding elements are set in motion along a direction substantially transverse to the longitudinal axis of the duct.

6. A device as in claim 1, wherein each of the occluding elements is translatable between the first position and the second position.

7. A device as in claim 6, wherein the occluding elements occupy a single plane substantially transverse to the longitudinal axis of the duct.

8. A device as in claim 6, wherein the dispensing outlet affords a slide channel, and each of the occluding elements presents at least one peripheral portion slidably engaging the channel.

9. A device as in claim 6, wherein the occluding elements each comprise at least one peripheral sliding surface and are butted slidably one against another by way of the respective peripheral sliding surfaces.

10. A device as in claim 1, wherein each of the occluding elements is rotatable between the first position and the second position.

11. A device as in claim 10, wherein each of the occluding elements presents a substantially wedge-like portion terminating in a relative vertex positionable to coincide with the longitudinal axis of the duct when the occluding element occupies the first position.

12. A device as in claim 10, wherein each of the occluding elements is pivotally associated with the periphery of the duct and rotatable thus about an axis substantially parallel to the longitudinal axis of the selfsame duct.

13. A device as in claim 10, wherein each of the occluding elements presents a slot and a pivot extending longitudinally in a direction substantially parallel to the longitudinal axis of the duct and insertable in the slot of the adjacent occluding element in such a way that the occluding elements are connected mechanically one to another.

14. A device as in claim 11, wherein the wedge-like portion of each occluding element is disposed radially in relation to the dispensing outlet when the occluding element occupies the first position.

15. A device as in claim 10, wherein the occluding elements overlap one another at least in part, at least when occupying the first position.

16. A device as in claim 11, wherein each of the occluding elements is disposed with the wedge-like portion tangential to the dispensing outlet when occupying the second position.

17. A device as in claim 10, comprising a plurality of link elements each presenting a first end hinged to one relative occluding element and a second end remote from the first and hinged to another relative occluding element, in such a way that the occluding elements are connected mechanically one to another.

18. A device as in claim 17, comprising drive means including at least one actuator associated with at least one of the link elements.

19. A device as in claim 3, comprising drive means including at least one actuator associated with at least one of the occluding elements.

20. A device as in claim 13, comprising drive means including at least one actuator associated with at least one of the occluding elements.

21. A dispensing device in machines for filling containers with powder material, comprising:

a feed duct referable to a longitudinal axis and furnished with at least one outlet from which powder material is dispensed into a corresponding container;

closure means associated with the outlet, capable of movement between an operating condition in which the outlet is closed to disallow the passage of the powder material and a non-operating condition in which the outlet remains open, and drive means comprising a single actuator associated with only one of the occluding elements, wherein the closure means comprises a plurality of occluding elements each capable of movement between a first position corresponding to the operating condition of the closure means and at least a second position corresponding to the non-operating condition of the closure means, each occluding element obscuring a part of the dispensing outlet when in the first position and combining with the remaining elements when in the second position to establish a flow section affording a passage to the powder material, each occluding element being directly and mechanically connected with at least one other adjacent occluding element.

* * * * *